US006647997B2

(12) United States Patent
Mohn

(10) Patent No.: US 6,647,997 B2
(45) Date of Patent: Nov. 18, 2003

(54) PAINT GUN WASHER

(76) Inventor: Merrill K. Mohn, P.O. Box 114, Woodbine, IA (US) 51579

( * ) Notice: Subject to any disclaimer, the term of this patent is extended or adjusted under 35 U.S.C. 154(b) by 266 days.

(21) Appl. No.: 09/859,074

(22) Filed: May 16, 2001

(65) Prior Publication Data

US 2002/0170978 A1 Nov. 21, 2002

(51) Int. Cl.[7] ..... B08B 3/02

(52) U.S. Cl. ..... 134/56 R; 134/57 R; 134/166 R; 134/169 R; 134/200

(58) Field of Search ..... 134/56 R, 57 R, 134/166 R, 166 C, 169 R, 169 C, 200

(56) References Cited

U.S. PATENT DOCUMENTS

| | | | | |
|---|---|---|---|---|
| 2,899,929 | A | * | 8/1959 | Monroe |
| 3,600,911 | A | * | 8/1971 | McLagan |
| 3,978,694 | A | * | 9/1976 | Hughes et al. |
| 4,096,714 | A | * | 6/1978 | Nirenberg |
| 4,459,831 | A | * | 7/1984 | Grandi |
| 4,823,820 | A | * | 4/1989 | Larson et al. |
| 5,193,561 | A | * | 3/1993 | Robb et al. |
| 5,213,117 | A | * | 5/1993 | Yamamoto |
| 5,704,381 | A | * | 1/1998 | Millan et al. |
| 5,794,299 | A | * | 8/1998 | Gockel et al. |

FOREIGN PATENT DOCUMENTS

| | | | |
|---|---|---|---|
| DE | 3634622 | * | 4/1988 |
| WO | WO 96/13630 | * | 5/1996 |

OTHER PUBLICATIONS

Product Brochure—Doumar Solvent Recovery Systems, Inc.
Product Brochure—Purg Clean Solvxtractor.
Product Catalog—R&D Fountain Industries Co. (1998).
Product Brochure—Herkules Equipment Corporation.

* cited by examiner

*Primary Examiner*—Frankie L. Stinson

(57) ABSTRACT

A paint gun washer includes a cabinet supported on a frame, the cabinet having an operable door in the forward wall and a switch connected to the door to continuously operate a vent in the cabinet while the door is open. A tank is mounted in the bottom wall of the cabinet and includes an operable door permitting access to the interior of the tank. Components to be washed with solvent are located within the tank, and a spray nozzle and/or hand brush are used to direct solvent on to the components. A valve connects the nozzle and/or brush with recirculated solvent from the tank. A separate rinse nozzle sprays the component with clean solvent. Foot operated switches activate pumps to dispense the solvent through the spray nozzle or brush. A filter panel is mounted in the cabinet spaced above the tank to prevent solvent from the tank from contacting the filter media.

16 Claims, 5 Drawing Sheets

PAINT GUN WASHER

CROSS-REFERENCES TO RELATED APPLICATIONS (Not applicable).

STATEMENT AS TO RIGHTS TO INVENTIONS MADE UNDER FEDERALLY SPONSORED RESEARCH AND DEVELOPMENT (Not applicable).

BACKGROUND OF THE INVENTION (1) Field of the Invention

The present invention relates generally to apparatus for cleaning tools and the like with solvent, and more particularly to an improved paint gun washing apparatus.

(2) Background Information

Paint gun washers are a common piece of equipment found in many automotive repair shops and the like. Typically they include a spray nozzle for spraying solvent directly on the components of the spray paint gun, and a tub or basin within which the components can soak in the solvent. Some washers include automatic cycles for automatically washing the paint gun.

However, current spray gun washing apparatus suffer a number of problems. Typically, prior art gun washers require manipulation of knobs or switches with the hands in order to operate the apparatus. Since the hands are commonly used during the cleaning operation, it is necessary to stop the cleaning operation whenever it is desired to turn the machine off, or change the settings of the machine.

Another problem with prior art gun washers is the location of the filter for the exhaust system. It is typically located directly behind the location for test painting of components or panels, thereby causing paint to directly impinge upon the filter during this test spray of a panel. This in turn requires replacement of filters more frequently, since the filter material becomes clogged much more quickly.

Finally, prior art gun washers conventionally utilize powered air vents to vent the washer cabinet. However, such vents are typically manually operated. Thus, a user may forget to turn the vent on or off during and after use.

BRIEF SUMMARY OF THE INVENTION

It is therefore a general object of the present invention to provide an improved paint gun washer.

Another object is to provide a paint gun washer which is activated and deactivated without using the hands.

Another object of the present invention is to provide a spray gun washer with a filter for the vent system which is located to prevent test spray and solvent from impinging on the filter.

A further object is to provide a paint gun washer which will automatically operate the vent system when the cabinet is in use, and turn off the vent system when the cabinet is closed and not in use.

These and other objects of the present invention will apparent to those skilled in the art.

The paint gun washer of the present invention includes a cabinet supported on a frame, the cabinet having an operable door in the forward wall and a switch connected to the door to continuously operate a vent in the cabinet while the door is open. A tank is mounted in the bottom wall of the cabinet and includes an operable door permitting access to the interior of the tank. Components to be washed with solvent are located within the tank, and a spray nozzle and/or hand brush are used to direct solvent on to the components. A valve connects the nozzle and/or brush with recirculated solvent from the tank. A separate rinse nozzle sprays the component with clear solvent. Foot operated switches activate pumps to dispense the solvent through the spray nozzle or brush. A filter panel is mounted in the cabinet spaced above the tank to prevent solvent from the tank from contacting the filter media.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
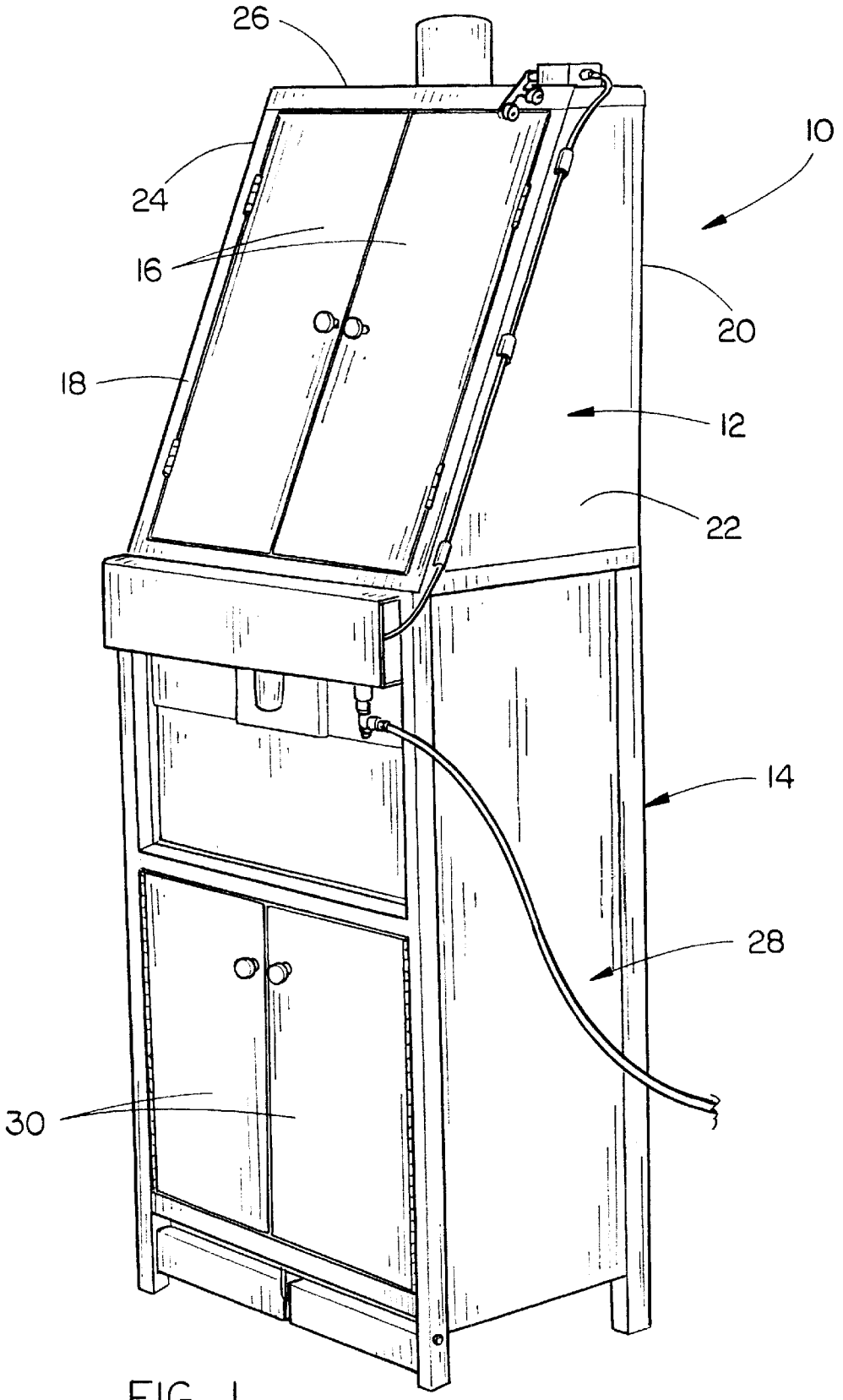
FIG. 1 is a perspective view of the paint gun washer of the present invention.

Referring now to the drawings, and more particularly to FIG. 1, the paint gun washer of the present invention is designated generally at 10 and includes a cabinet 12 supported on a frame 14, the cabinet having a pair of operable doors 16 in a forward wall 18 thereof. Cabinet 12 further includes a rearward wall 20 opposing side walls 22 and 24 and a top wall 26.

Frame 14 includes an enclosed storage cabinet 28 in the lower end thereof, with a pair of operable doors 30 and a forward wall, permitting access to the interior of storage cabinet 28.

Figure 2:
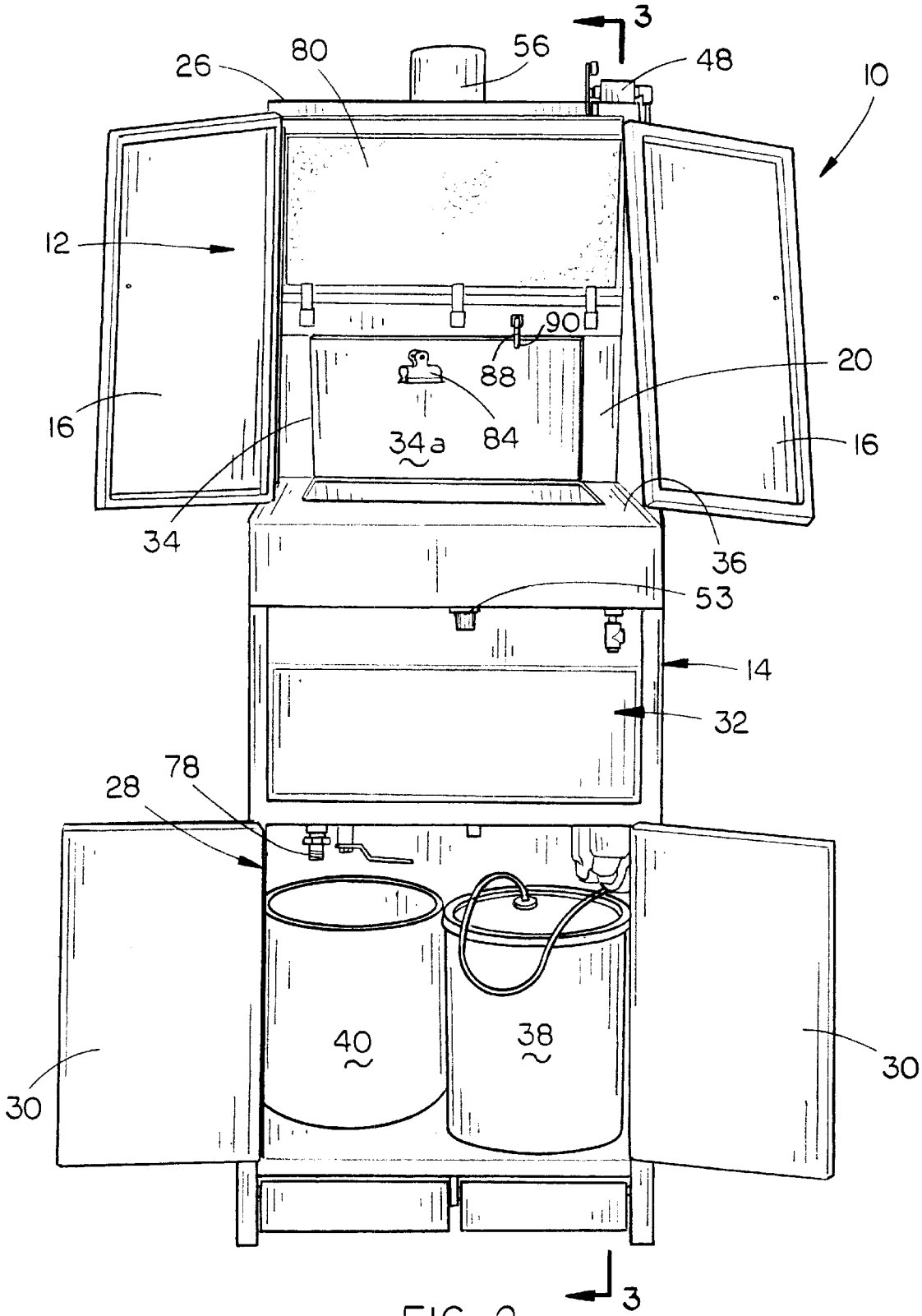
FIG. 2 is a front elevational view of the washer, with the various cabinet doors open to reveal the interior thereof.
Figure 3:
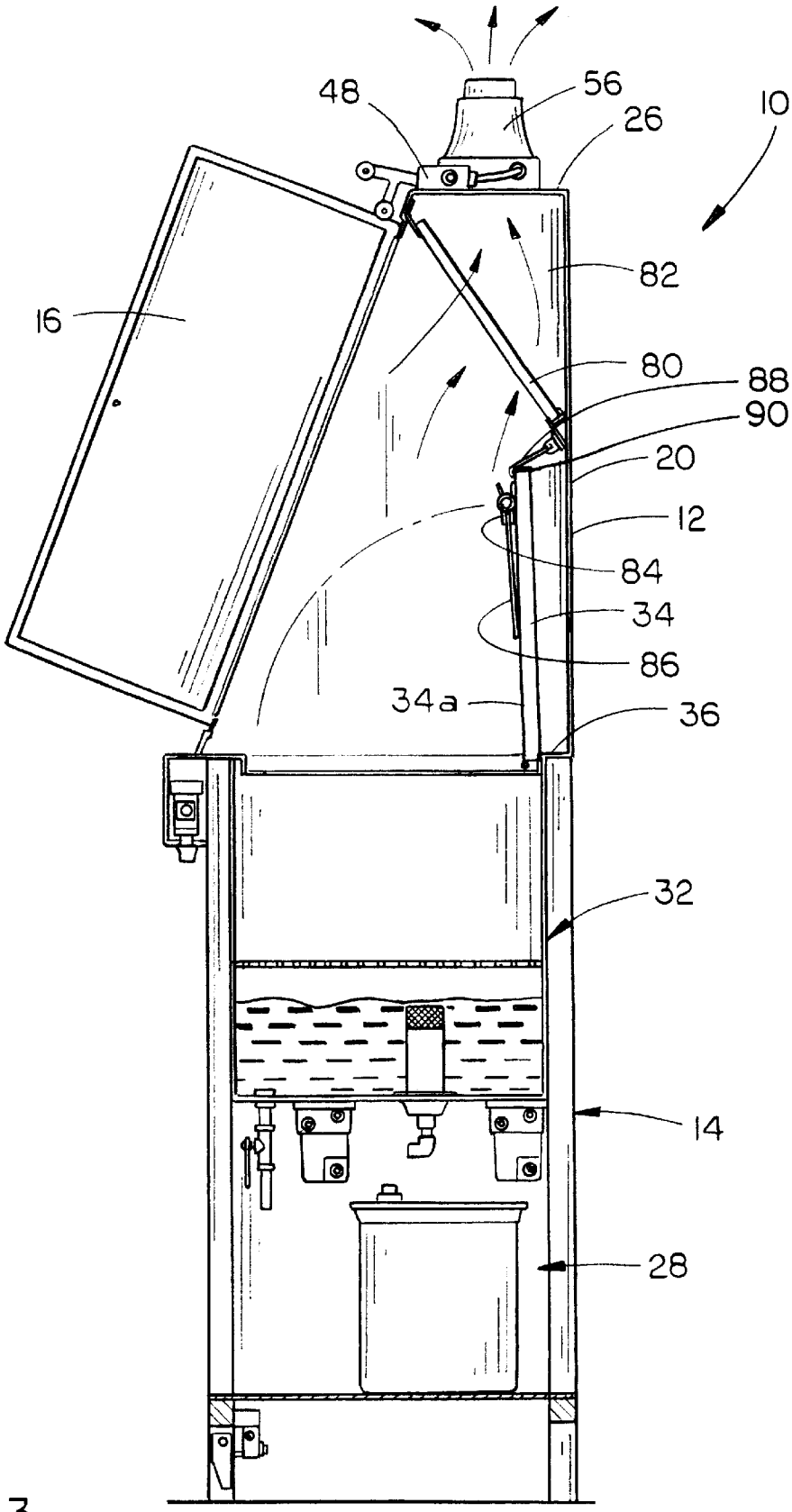
FIG. 3 is a sectional view taken at lines 3—3 in FIG. 2.

Referring now to FIGS. 2 and 3, an enclosed tank 32 is mounted within frame 14 above storage cabinet 28, and includes an operable door 34 mounted in the top wall 36 to permit access to the interior of tank 32. Tank 32 is formed of a material which will receive solvents therein, for the cleaning of paint spray guns and/or other components. Storage cabinet 28 is of a size to receive two five gallon containers 38 and 40, and permit closing of doors 30. Preferably, container 40 will receive used, "dirty" solvent from tank 32, while container 38 will supply clean solvent to the washer 10, as described in more detail hereinbelow.

Figure 4:
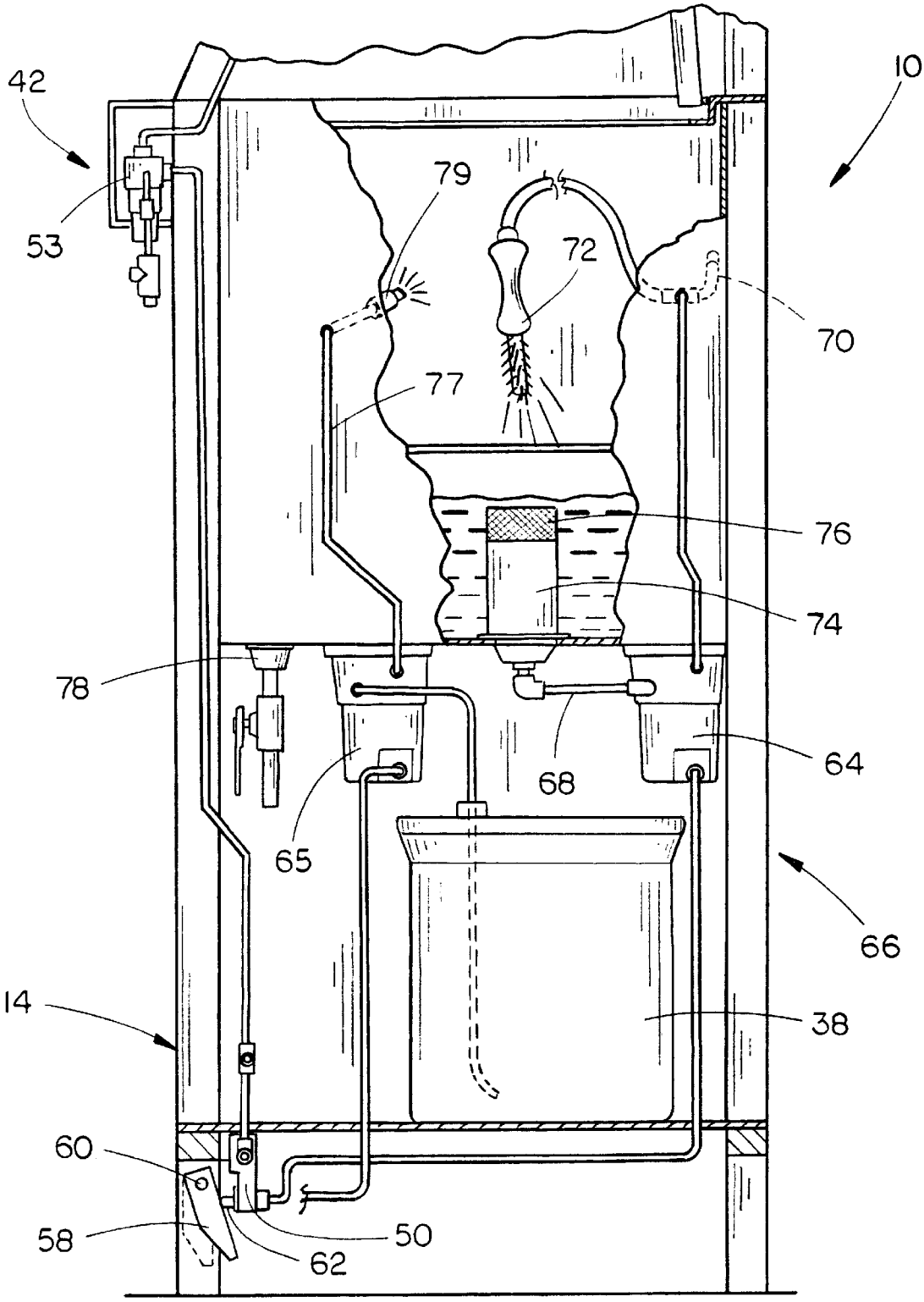
FIG. 4 is an enlarged view of a portion of FIG. 3, showing various hydraulic and pneumatic lines of the invention.
Figure 5:
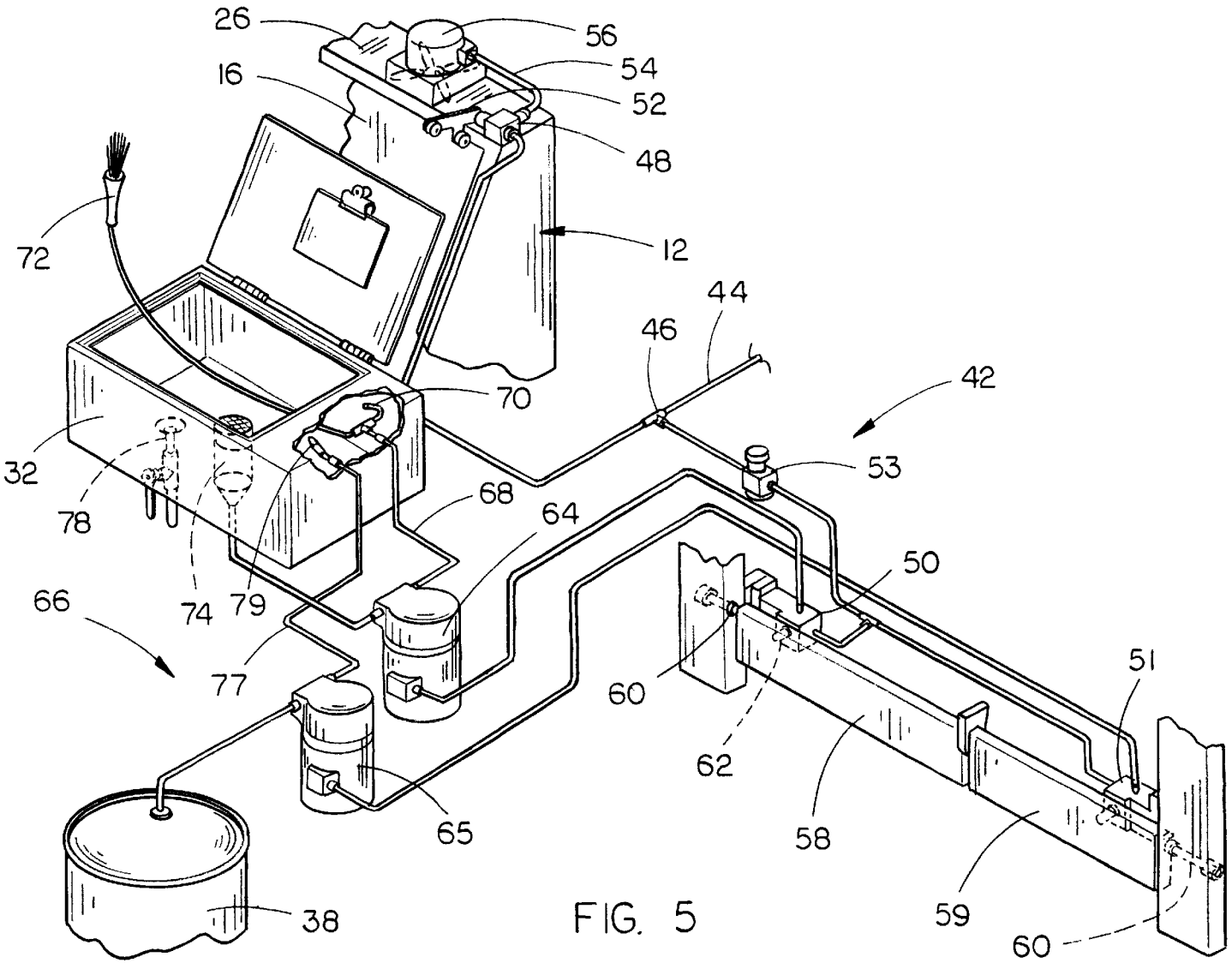
FIG. 5 is a perspective schematic view showing the various fluid lines of the invention.

Referring now to FIGS. 4 and 5, the fluid systems of washer 10 are shown in more detail. The pneumatic system is designated generally at 42 and includes an air line 44 extending from a source of air under pressure. The source air line 44 is divided at a tee 46 from which one line extends to an upper activation switch 48 and a second line extends to lower activation switches 50 and 51. Upper switch 48 includes an actuator arm 52 operably mounted in association with the cabinet doors 16, such that switch 48 is moved to an "on" or "open" position when doors 16 are opened. An air line 54 extends from switch 48 to an air venturi 56 mounted in the cabinet top wall 26 to vent air from the interior of cabinet 12. While the preferred form of the invention utilizes an air venturi 56, other vent apparatus for removing air from cabinet 12, such as a fan, are alternatives to the air ventilation system shown. Because switch 48 remains in an "on" position at all times when the doors 16 of cabinet 12 are open, the cabinet 12 is continuously ventilated while doors 16 are open. Similarly, when doors 16 are closed, the ventilation system is automatically turned off, by movement of actuator arm 52 to a closed or "off" position.

The second pneumatic line from tee 46 first extends to an air regulator 53 and is then divided at a tee before extending to switches 50 and 51. Switch 50 is positioned proximal to a first actuator plate 58 which is pivotally suspended on a horizontally extending rod 60 connected to frame 14. Actuator plate 58 will thereby normally hang in a vertical orientation immediately adjacent switch 50. When actuator plate 58 is pivoted inwardly/rearwardly on rod 60, by the operator's foot, plate 58 will actuate an actuator arm 62 on lower switch 50 to open lower switch 50 and permit air from source line 44 to continue to a pump 64 to operate the pump. Actuator arm 62 is spring loaded, so that removal of the operator's foot from plate 58 will permit the plate to return to the vertical position, and permit actuator arm 62 to return to an extended "off" position, which in turn stops operation of pump 64.

Switch 51 is positioned proximal to a second actuator plate 59 which is pivotally suspended on rod 60, so as to hang generally vertically adjacent switch 51. When actuator plate 59 is pivoted inwardly and rearwardly on rod 60 by the operator's foot, plate 59 will actuate switch 51 to permit air from source line 44 to continue to a second pump 65. Switch 51 has a spring loaded actuator arm, similar to switch 50, such that pump 65 will be turned off when the operator's foot is removed from plate 59.

The solvent carrier system is also shown in FIGS. 4 and 5, and is designated generally at 66. The solvent carrier system utilizes pump 64 to recirculate solvent through a pipeline 68 to a spout 70 and a brush 72, both of which are located within tank 32 to dispense the solvent on the component to be cleaned. Pipeline 68 is connected to a cylindrical drain 74 in tank 32. Drain 74 includes a screen and/or filter 76 around its upper end to remove particulate from the solvent as it is drawn from tank 32. Because screen 76 is near the upper end of drain 74, the particulate-laden "dirty" solvent is not recirculated.

Clean solvent in container 38 is pumped by pump 65 through pipeline 77 to a spray nozzle 79, as shown in FIGS. 4 and 5. Activation of pump 65 by plate 59 will cause clean solvent to be sprayed through spray nozzle 79, to rinse a component being washed in tank 32.

A tank drain 78 is shown in FIGS. 2 and 5, and includes an operable valve permitting selective draining of the tank into container 40 (shown in FIG. 2) for removal and disposal or other treatment.

Referring once again to FIGS. 2 and 3, it can be seen that the air filter 80 is a generally rectangular panel of filter media material which is mounted between an upper portion of the cabinet rearward wall 20 and the top wall 26 so that the filter is spaced upwardly above tank 32 and the upper edge of the filter leans forwardly at an angle to the vertical. In this way, filter 80 forms an air chamber 82 through which air is drawn by the air venturi 56 to vent cabinet 12. The positioning of filter 80 spaced above tank 32 also prevents the direct contact of solvent, paint spray, and the like with the filter media of filter 80, to thereby increase the life and efficiency of the filter media.

Tank door 34 pivots between a closed horizontal position and an open position slightly less than vertical, leaning forwardly against a fusible link 88 with a hook 90 connected to the cabinet rearward wall 20, as shown in FIGS. 2 and 3. It can be seen that filter 80 has its lower most edge positioned spaced above the upper end of door 34. A clip 84 is mounted on the inward face 34*a* of door 34, and is designed to receive a test panel 86 thereon. Test panel 86 permits an operable to spray paint on the panel to determine the actual color of the paint being used. Because the test panel is positioned on the inward face 34*a* of door 34, any overspray will reside on the door face 34*a*, rather than on the cabinet back wall 20 or in the filter 80. This permits simple and effective cleaning of the paint from the door during use of the washer to clean various components.

As shown in FIGS. 2 and 3, fusible link 88 and hook 90 retain the door 34 in an upright position, permitting access to tank 32. Because door 34 is positioned and oriented to lean forwardly at an angle slightly less than vertical, operation of the fusible link 88, in the event of a fire, will cause door 34 to immediately drop downwardly to the horizontal closed position.

Whereas the invention has been shown and described in connection with the preferred embodiment thereof, many modifications, substitutions and additions may be made which are within the intended broad scope of the appended claims.

What is claimed is:

1. A paint gun washer apparatus, comprising:

an enclosed cabinet supported on a frame, the cabinet having forward and rearward walls, opposing side walls and top and bottom walls enclosing an interior;

said cabinet including a door operably mounted on the forward wall for movement between open and closed positions; and operable ventilation means mounted in the cabinet in communication with the interior, and having means for operating the ventilation means to continuously draw air out of the interior of the cabinet when the door is open, and to cease drawing air when the door is closed;

said means for operating the ventilation means including a switch mounted on the cabinet proximal to the door and operable to operate the ventilation means in response to movement of the door to the open position, and to cease operation of the ventilation means in response to movement of the door to the closed position;

said ventilation means including an air venturi connected via a pneumatic line to a source of air under pressure;

said switch being a pneumatic switch connected to the pneumatic line and operable between an open condition permitting air to pass through the line when the door is open, and a closed position preventing passage of air through the line when the door is closed.

2. The apparatus of claim 1, further comprising:

an enclosed tank supported in the frame and mounted in the bottom wall of the cabinet, said tank formed of a material inert to liquid solvent;

an operable door mounted in a top wall of the tank, operable between a generally vertical open position and a closed horizontal position;

a spray nozzle mounted within the tank for dispensing solvent to wash articles within the tank, said spray nozzle fluidly connected via a fluid line to a source of clean solvent;

a first pump interposed in the fluid line between the source of clean solvent and the nozzle, for selectively pumping the fluid;

a spout mounted within the tank for dispensing solvents to wash articles within the tank, said spout fluidly connected via a fluid line to a drain in the tank; and a second pump interposed in the fluid line between the tank drain and spout, for selectively pumping solvent from the tank drain to the spout.

3. The apparatus of claim 2, further comprising first foot actuated means for selectively activating said first pump, and second foot actuated means for selectively activating the second pump.

4. The apparatus of claim 3, wherein said first foot actuated means includes:

a first plate pivotally mounted on said frame on a generally horizontal axis, having a center of gravity located below the axis such that the plate is suspended generally vertically; and a first lower switch located proximal the first plate and operably connected to the first pump to actuate the pump when the first lower switch is in an "on" position, and deactivate the pump when the first lower switch is in an "off" position;

said first lower switch including an actuator arm operable between a first position moving the first lower switch to the "on" position, and a second position moving the first lower switch to the "off" position;

said actuator arm being spring loaded, and located proximal the first plate such that the plate contacts the arm and moves the arm to the first position when the plate is pushed and pivoted, and such that the first plate vertical position allows the first lower switch arm to return to the second position.

5. The apparatus of claim 4, wherein said second foot actuated means includes:

a second plate pivotally mounted on said frame on a generally horizontal axis coaxial with the pivot axis of the first plate, having a center of gravity located below the axis such that the second plate is suspended generally vertically; and a second lower switch located proximal the second plate and operably connected to the second pump to actuate the pump when the second lower switch is in an "on" position, and deactivate the second pump when the second lower switch is in an "off" position;

said second lower switch including an actuator arm operable between a first position moving the second lower switch to the "on" position, and a second position moving the second lower switch to the "off" position;

said second lower switch actuator arm being spring loaded, and located proximal the second plate such that the second plate contacts the arm and moves the arm to the first position when the plate is pushed and pivoted, and such that the second plate vertical position allows the second lower switch arm to return to the second position.

6. The apparatus of claim 5, wherein said tank drain includes a housing extending vertically upwardly into the tank from the tank bottom, and a drain portion formed proximal an upper end of the housing, spaced from the tank bottom.

7. The apparatus of claim 6, wherein the pumps are pneumatic pumps and the lower switches are pneumatic switches, said pumps connected to the pneumatic line, and the lower switches interposed between the pumps and the air source to selectively permit passage of air to the pumps when the lower switches are in the "on" position.

8. The apparatus of claim 2, wherein said tank drain includes a housing extending vertically upwardly into the tank from the tank bottom, and a drain portion formed proximal an upper end of the housing, spaced from the tank bottom.

9. A paint gun washer apparatus, comprising:

an enclosed cabinet supported on a frame, the cabinet having forward and rearward walls, opposing side walls and top and bottom walls enclosing an interior;

said cabinet including a door operably mounted on the forward wall for movement between open and closed positions;

an enclosed tank supported in the frame and mounted in the bottom wall of the cabinet;

an operable door mounted in a top wall of the tank, operable between a generally vertical open position and a closed horizontal position; and operable ventilation means mounted in the cabinet in communication with the interior, and having means for operating the ventilation means to continuously draw air out of the interior of the cabinet when the door is open, and to cease drawing air when the door is closed;

said ventilation means including an air filter mounted in the cabinet and spaced vertically above the tank;

said filter being generally rectangular, with upper and lower edges and opposing side edges, and located with the lower edge connected to the cabinet rearward wall and spaced above the tank top wall, the upper edge connected to the cabinet top wall and spaced forwardly of the cabinet rearward wall, and the side edges extending to the cabinet side walls.

10. The apparatus of claim 9, wherein the tank door includes a pivot edge, a forward edge opposing the pivot edge, opposing side edges, and diametric inward and outward faces, and wherein the filter lower edge is located on the rearward cabinet wall at a height greater than the distance between the tank door pivot edge and tank door forward edge.

11. The apparatus of claim 10, the tank door inward face has an operable clip thereon for selectively holding a test panel on the door adjacent the door inward face.

12. A paint gun washer apparatus, comprising:

an enclosed cabinet supported on a frame, the cabinet having forward and rearward walls, opposing side walls and top and bottom walls enclosing an interior;

said cabinet including a door operably mounted on the forward wall for movement between open and closed positions;

operable ventilation means mounted in the cabinet in communication with the interior, and having means for operating the ventilation means to continuously draw air out of the interior of the cabinet when the door is open, and to cease drawing air when the door is closed;

an enclosed tank supported in the frame and mounted in the bottom wall of the cabinet, said tank formed of a material inert to liquid solvent;

an operable door mounted in a top wall of the tank, operable between a generally vertical open position and a closed horizontal position;

a spray nozzle mounted within the tank for dispensing solvent to wash articles within the tank, said spray nozzle fluidly connected via a fluid line to a source of clean solvent;

a first pump interposed in the fluid line between the source of clean solvent and the nozzle, for selectively pumping the fluid;

a spout mounted within the tank for dispensing solvents to wash articles within the tank, said spout fluidly connected via a fluid line to a drain in the tank; and a second pump interposed in the fluid line between the tank drain and spout, for selectively pumping solvent from the tank drain to the spout.

13. The apparatus of claim 12, further comprising first foot actuated means for selectively activating said first pump, and second foot actuated means for selectively activating the second pump.

14. The apparatus of claim 13, wherein said first foot actuated means includes:

a first plate pivotally mounted on said frame on a generally horizontal axis, having a center of gravity located below the axis such that the plate is suspended generally vertically; and a first lower switch located proximal the first plate and operably connected to the first pump to actuate the pump when the first lower switch is in an "on" position, and deactivate the pump when the first lower switch is in an "off" position;

said first lower switch including an actuator arm operable between a first position moving the first lower switch to the "on" position, and a second position moving the first lower switch to the "off" position;

said actuator arm being spring loaded, and located proximal the first plate such that the plate contacts the arm and moves the arm to the first position when the plate is pushed and pivoted, and such that the first plate vertical position allows the first lower switch arm to return to the second position.

15. The apparatus of claim 14, wherein said second foot actuated means includes:

a second plate pivotally mounted on said frame on a generally horizontal axis coaxial with the pivot axis of the first plate, having a center of gravity located below the axis such that the second plate is suspended generally vertically; and a second lower switch located proximal the second plate and operably connected to the second pump to actuate the pump when the second lower switch is in an "on" position, and deactivate the second pump when the second lower switch is in an "off" position;

said second lower switch including an actuator arm operable between a first position moving the second lower switch to the "on" position, and a second position moving the second lower switch to the "off" position;

said second lower switch actuator arm being spring loaded, and located proximal the second plate such that the second plate contacts the arm and moves the arm to the first position when the plate is pushed and pivoted, and such that the second plate vertical position allows the second lower switch arm to return to the second position.

16. The apparatus of claim wherein the pumps are pneumatic pumps and the lower switches are pneumatic switches, said pumps connected to the pneumatic line, and the lower switches interposed between the pumps and the air source to selectively permit passage of air to the pumps when the lower switches are in the "on" position.

* * * * *